United States Patent [19]

Giovanni et al.

[11] 4,375,267

[45] Mar. 1, 1983

[54] APPARATUS FOR AUTOMATICALLY LAYING OUT A STOCKING, COLLANT OR THE LIKE

[75] Inventors: Chietti Giovanni; Fabio Selvi, both of Florence, Italy

[73] Assignee: C.K.S. S.n.c., Florence, Italy

[21] Appl. No.: 178,717

[22] Filed: Aug. 18, 1980

[30] Foreign Application Priority Data

Sep. 4, 1979 [IT] Italy ..... 25475 A/79

[51] Int. Cl.[3] ..... A47J 51/06

[52] U.S. Cl. ..... 223/112

[58] Field of Search ..... 223/37, 36, 60, 75, 223/76, 77, 112

[56] References Cited

U.S. PATENT DOCUMENTS 2,136,902 11/1938 Griffin ..... 223/112

3,319,851 5/1967 Horberg ..... 223/112

*Primary Examiner*—Louis Rimrodt

*Attorney, Agent, or Firm*—Oblon, Fisher, Spivak, McClelland & Maier

[57] ABSTRACT

Apparatus for automatically laying out stockings or collants for visual control and possible treatments thereof. The apparatus comprises a rigid shaped form, having a stocking inlet applied thereto, and an elongated element movable between a position, at which it is within the form, and a position, at which is projects from the form, stretching out the stacking that can be therefore controlled. At its stretched out position, the stocking tip is automatically gripped by a pliers, while the movable element is withdrawn, thereby leaving the stocking hanging from the pliers.

3 Claims, 5 Drawing Figures

APPARATUS FOR AUTOMATICALLY LAYING OUT A STOCKING, COLLANT OR THE LIKE

BACKGROUND OF THE INVENTION

This invention relates to an apparatus for automatically laying out a stocking, collant or the like, for visual inspection and possible treatment thereof.

It is well known that knitted hose articles, particularly stockings, collants and the like, have to be stretched out after manufacture thereof in order to check for manufacturing defects and to provide for subjecting them to possible treatments, such as drying, finish treatments or the like.

At present this stocking and collant stretching out operation is manually carried out, by superimposing rigid forms into the stockings and collants, on which the latter are manually stretched out.

The stockings and collants are then removed from these rigid forms for delivery to further treatments.

The prior art suffers from substantial drawbacks, primarily that the stocking loading and stretching out operation on the supporting forms requires considerable time, thus resulting in a low hourly output of controlled stockings and a considerable increase in production costs thereof.

SUMMARY OF THE INVENTION

It is the primary object of the present invention to provide an apparatus by means of which the stockings and collants can be automatically laid out and inspected and by which the stretched out stockings and collants can be possibly subjected to treatment, in a very short time and accordingly with high hourly outputs and low costs.

It is another object of the invention to provide an apparatus of the above mentioned type, which is economical to manufacture and reliable in operation.

These and still further objects are achieved by an apparatus including a rigid shaped form for supporting the inlet portion of a stocking, an elongated element movable within the rigid form between a position at which the free end of said element is substantially aligned with the free end of the form, and a position at which the end of the elongated element extends beyond the free end of the form. Also included are means for controlling the movement of the elongated element between said two positions thereof, power rollers located one at each side of said rigid form, means causing the two rollers to move near each other until contacting with said form and operating said motor for causing the rollers to be rotated in the direction of drawing and applying the stocking to the form, means for successively moving the rollers away from the form. A further device successively causes the movement of the elongated element, causing it to project from the form and stretch out the stocking. Pliers are provided for gripping the stocking tip on the end of the elongated element, on which said control device is effective to reenter it in said form, leaving the stocking at free state and hanging from the pliers.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
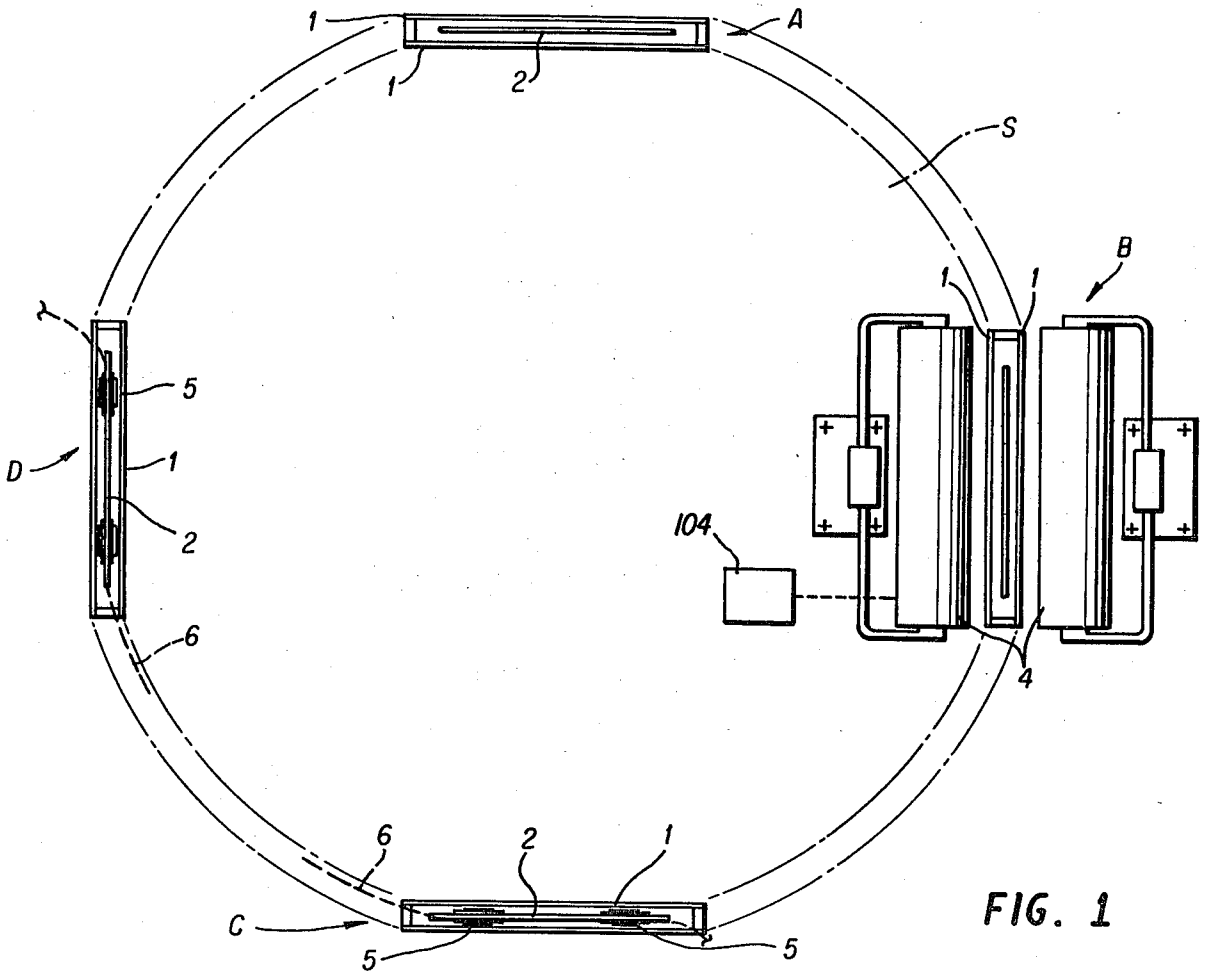
FIG. 1 is a diagrammatic plan view of an apparatus mounted on a movable support at four successive operating station.

As particularly shown by FIGS. 1 and 2A–2D, an apparatus according to the invention comprises a rigid shaped form 1 which, in the embodiment shown, is shaped with upward extending projections, intended for supporting a collant. Essentially, such a rigid form 1 comprises two rigid plates juxtaposed to each other, between which an elongated element 2 is movably positioned, such an element having two flattened rods, the two ends of which, designated both by reference numeral 3, normally project beyond the upper free end of form 1 at stations A and B, to be discussed below, and which have been shown in succession in FIGS. 2A–2D.

Said form 1 and elongated element 2 are mounted on a rigid support, simply outlined and designated by reference letter S in FIG. 1. The support intermittently rotates, causing said form to stop successively at the four stations, respectively designated by reference letters A, B, C and D (in FIG. 1, station D has been shown closer to the axis of rotation of support S only for the sake of reducing the drawing size).

While said rigid form 1 is fixed or stationary on the rotating support S, the elongated element 2 is connected to a driving motor or other member 102 (such as, for example, a cam, hydraulic or pneumatic piston, electromagnetic driving member or the like) capable of causing said element 2 to be displaced from the lowered position, taken at stations A and B, to an extended position taken on passing from station B to station C, where the free ends 3 of element 2 are entirely projecting above said form 1.

At the successive passage from station C to station D, automatic members, such as for example cams or electrical control members 103, will lower said element 2, bringing it back at station D to the same position as at station A.

Two power rollers are provided at station B, designated by reference numeral 4 and positioned one at one side and the other at the other side of said rigid form 1, as particularly shown in FIG. 1.

At such a station B, members are provided such as, for example, electrical contacts or switches operated, for example, by said form 1, for moving the two rollers 4 near each other until the rollers press on said form 1, and causing said rollers to rotate such that the roller surfaces thereof contacting said form 1 move downward on form 1.

Figure 2A:
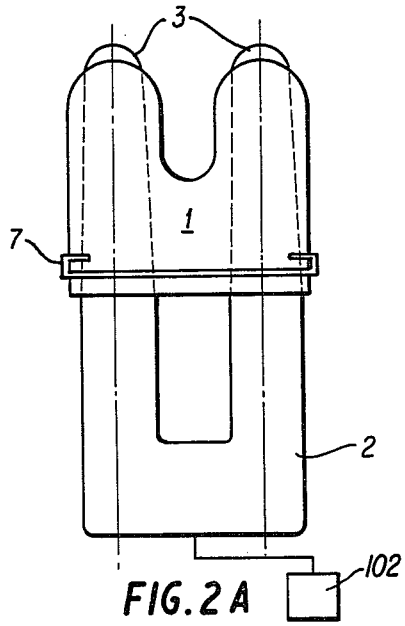
FIGS. 2A–2D separately, and view, and in front elevational view shows the mutual positions taken by the rigid shaped form and movable element housed therein at the four successive positions or stations shown in FIG. 1.
Figure 2B:
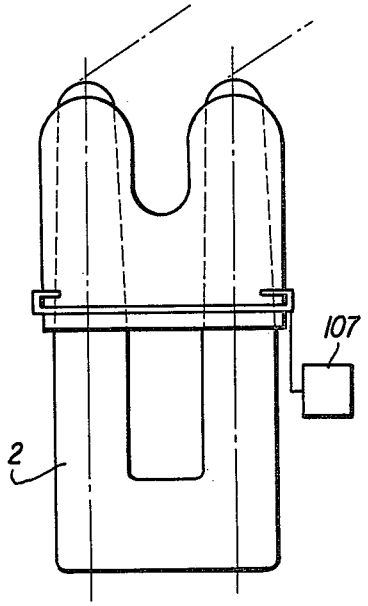

Now, assume that the device is at station A, where said element 2 is fully lowered relative to form 1 (FIG. 2A). At this station, an operator can simply apply the inlet waist of a collant onto the upper shaped ends of said rigid form 1, which operation is a very fast and easily carried out.

At the successive passage to station B, when the rotational movement of support S is stopped for a very short period of time, the two rollers 4 are pressed in contact with the free inlet or waist of the collant and, by rotating, will entirely draw it on form 1, drawing the collant legs over the shaped projections of form 1. At the end of this operation of complete drawing of the collant on form 1, a known type of friction device 104 moves said two rollers 4 away from form 1 and causes the stopping thereof.

Figure 2C:
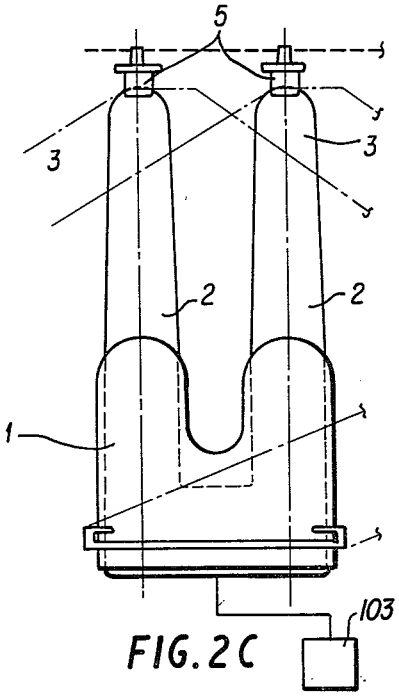

Then, said support S moves through a further step and, on passing of said form from station B to station C, a cam or other automatic member, 102 causes the upward lifting of said elongated element 2 and exit of ends 3 of said elongated element, upward drawing the tips of the collant legs, as particularly shown in FIG. 2C.

At the end of this lifting operation of the elongated element 2, while the apparatus is still at station C, said element 2 acts upon a microswitch causing the closure of two grippers 5, which are located just above the free ends 3 of element 2 and which accordingly grip the tips of the legs or stockings of the collant. Such grippers 5 are carried by a chain 6 shown by dashed line in the figures of the drawings.

Figure 2D:
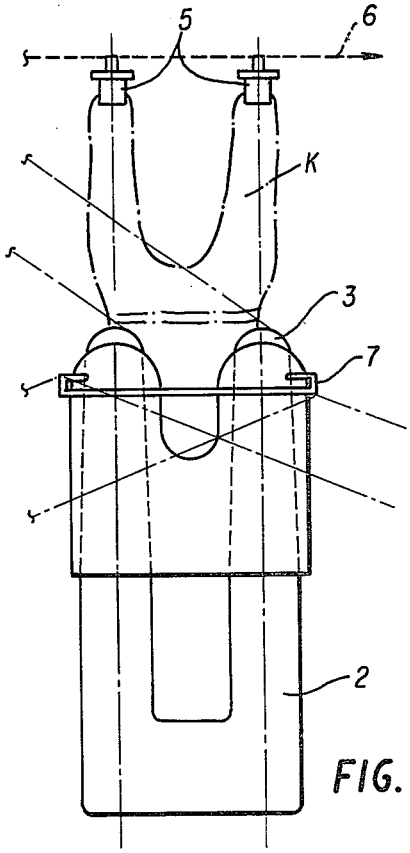

Now, still through the action of a cam, hydraulic or pneumatic piston, or magnetic or electromagnetic member 103, on passing from station C to station D, said element 2 is lowered again (see FIG. 2D), leaving the collant, shown by dot-dashed line in FIG. 2D and designated by reference letter K, hanging from grippers 5, transferring it to a subsequent treatment, herein of no interest.

While the collant or stocking is stretched between said form 1 and element 2, which completely projects from said form, that is at the conditions of station C (and successively possibly as the collant is freely suspended at station D), such a material can be easily visually controlled or checked for any manufacturing defects.

While the collant is laid out at station C, and during its passage from station C to station D, it may be invested by a blow of hot air for complete drying thereof, or be subjected to a finish treatment or other treatment per se well known in the art.

For example, two heated movable walls (of a per se known structure) may be provided at station D, which walls move near each other, thus coming in contact with the collant and causing an automatic ironing thereof. At such a stage, the collant may be at a free state (hanging from the pliers), or may be still slipped on the forms.

In order to facilitate the separation of the collant from the rigid form 1, the latter has movably mounted thereon a kick-off or expeller member 7 which is at lowered position at stations A, B and C, and which is lifted, for example by means of a motor, cam or other members 107, as said form 1 arrives at station D (FIG. 2D), thus releasing the waist or inlet of the collant from said form 1.

The above described apparatus is of extremely simple structure and allows a fast and easy loading, stretching out, control and possible treatment of stockings, collants and the like, thus providing a considerable progress or advance with respect to the present known art.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for automatically stretching out a stocking, collant or the like for inspection and treatment, said apparatus comprising:

a hollow rigid form for receiving said stocking;

an elongated element supported within said rigid form, said elongated element being movable between a first position in which one end of said elongated element is substantially within one end of said rigid form, and a second position in which said one end of said elongated element extends substantially beyond said one end of said rigid form;

first means for moving said elongated element between said first and second positions;

opposed rollers positionable with said rigid form therebetween;

second means for moving said rollers towards and away from said rigid form;

means for rotating said rollers;

gripper means adjacent said one end of said elongated element at said second position; and means associated with said first and second means for moving, said means for rotating and said gripper means, for positioning said rollers adjacent said rigid form, rotating said rollers in a direction such that the periphery of said rollers move away from said one end of said elongated element, moving said elongated element from said first to said second position, and gripping the tops of stockings on said elongated element with said gripper means, whereby said stockings are visible for inspection.

2. The apparatus of claim 1 including a support movable in succession amongst four stations, said rigid form and elongated element being mounted on said support, wherein:

said stockings are mounted on said rigid form at a first said station;

said rigid form is positioned between said rollers at a second said station;

said elongated element moves from said first to said second position prior to said third station; and said elongated element moves from said second to said first position prior to said fourth station.

3. The apparatus of claim 2 including:

pusher means positioned in contact with said rigid form and movable between a first position opposite said one end of said rigid form and a second position adjacent said one end of said rigid form; and means for moving said pusher means between said first and second positions thereof;

whereby stockings can be removed from said rigid form.

* * * * *